United States Patent [19]

Herion et al.

[11] 4,237,930

[45] Dec. 9, 1980

[54] SAFETY VALVE

[75] Inventors: Erich Herion, Stuttgart; Erich Ruchser, Kernen, both of Fed. Rep. of Germany

[73] Assignee: Technomatic AG, Aesch, Switzerland

[21] Appl. No.: 950,632

[22] Filed: Oct. 11, 1978

[30] Foreign Application Priority Data

Nov. 14, 1977 [DE] Fed. Rep. of Germany ..... 2750895

[51] Int. Cl.[3] ..... F15B 13/043; F15B 13/08; F15B 20/00

[52] U.S. Cl. ..... 137/596.16; 91/424; 192/12 C

[58] Field of Search ..... 91/424; 137/596.16; 192/12 C

[56] References Cited

U.S. PATENT DOCUMENTS

| | | | |
|---|---|---|---|
| 3,068,897 | 12/1962 | Ruschser | 137/596.16 |
| 3,329,161 | 7/1967 | Ruschser | 137/596.16 |
| 3,583,438 | 6/1971 | Ruschser | 137/596.16 X |
| 4,138,005 | 2/1979 | Schneider et al. | 192/12 C |

*Primary Examiner*—Gerald A. Michalsky

*Attorney, Agent, or Firm*—Michael J. Striker

[57] ABSTRACT

The coupling and brake of a press receive pressurized fluid through a safety valve. The safety valve comprises two switching valves, so that if one of the switching valves fails and cannot close the other one can be closed. The safety valve is provided with a pressure-responsive switch which generates a shut-off signal commanding that the press be shut off, in response to a variety of malfunction situations, e.g., when the switching valves are closed but nevertheless a pressure build-up is occurring, or when the switching valves are open but the pressure being furnished to the coupling and brake does not reach or suddenly drops below the threshold levels to which the coupling and brake can respond. A differential pressure-responsive switch can be used to sense fluid flow through the safety valve; if the switching valves are moved to open setting, the differential pressure-responsive switch changes setting in response to the resulting fluid flow to the coupling and brake, but thereafter should revert to the previous setting and if it does not this triggers shut-off of the press.

4 Claims, 3 Drawing Figures

SAFETY VALVE

BACKGROUND OF THE INVENTION

The present invention concerns safety valves used in the control of pressurized-fluid consumers, especially hydraulically or pneumatically controlled couplings and brakes in presses. Safety valves of the type in question typically comprise a single valve housing accommodating two switching valves acting in parallel and used to control the feeding of pressure fluid (gaseous or liquid) to and from the consumer. The parallel-acting switching valves are for example activated by electromagnetically controlled pilot valves. Finally, such safety valves are provided with a safety device for switching off the consumer in the event of malfunction.

Safety valves of this type are used, for example, in order to be able to reliably shut off a press, in the event that one of the two switching valves fails, or in the event that one of the switching valves or its associated pilot valve does not activate properly. If that occurs, then it is known, for example to employ a piston manometer, or other safety device, which is activated by the pressurized fluid and moved by it out of inoperative position to a switch-activating position activating an emergency switch serving to shut off the electrical equipment of the press.

It is also known to sense the positions and strokes of the pistons of the two power-switching valves using contactless inductive or capacitive proximity detectors. These produce a signal in the event that the pistons of the two switching valves do not perform identical movements, i.e., when both valves are not opening or closing simultaneously. An assumption underlying this known technique is that a mulfunction reflected in the movement or position of one valve piston will not also be reflected in the movement or position of the other.

A disadvantage of these prior-art automatic monitoring techniques is that they do not indicate, for example, the fact that the valve head of one switching valve has broken or that the sealing ring of the valve seat of one of the valves has failed. Also, these techniques are not capable of detecting damage to or leakage from the connecting conduits between the safety valve(s) and the consumer(s).

SUMMARY OF THE INVENTION

It is a main object of the present invention to provide a safety valve of the type described above, but so designed as to deenergize the consumer in the event that one of the valve heads breaks or is damaged, or if the seal-tightness of one of the switching valves fails. The safety valve is furthermore to have the ability to trigger consumer deenergization in response to malfunctions occurring in the connecting conduits leading to the consumer, i.e., when for example the pressure of fluid supplied to the consumer falls below the threshold level to which the consumer can respond or when no or only an insufficient pressure build-up is occurring.

In accordance with the present invention this is achieved by providing the safety valve with at least one pressure-responsive switch which responds to malfunction by activating the safety or shut-off arrangement of the consumer involved.

The pressure-responsive switch is advantageously located intermediate the safety valve of the press and the consumer, for example in the housing of the safety valve, or in a connecting conduit intermediate the safety valve and the consumer, or within a pressurized compartment internal to the consumer.

Preferably, two independently operating pressure-responsive switches are provided. When the switching valves are closed, one pressure-responsive switch checks for residual pressure in the connecting conduit between the safety valve and the consumer, e.g., resulting from a malfunction at the switching valves or at the seals of the valves. When the switching valves are open, the other pressure-responsive switch is activated when the pressure in such connecting conduit falls below the threshold level to which the consumer can respond or when no or only an insufficient pressure build-up is occurring.

If the consumer comprises the coupling and brake of, for example, a press, and if the coupling and brake are separate, then advantageously each one, i.e., the coupling and the brake, is provided with two pressure-responsive switches, one responding to residual pressure and the other responding to failure to reach the pressure threshold level of the respective consumer (brake or coupling) or to the absence of a proper pressure build-up.

According to a further concept of the invention, the pressure-responsive switch can be a pressure-difference-responsive switch built into the conduit which conveys pressure fluid to the switching valves. Advantageously, each of the two switching valves is provided with a respective pressure-difference-responsive switch of its own.

According to another concept of the invention, two pressure compartments are formed, each one located upstream of a respective one of the two switching valves and communicating directly with the conduit which feeds fluid to the switching valves. Advantageously each pressure compartment accommodates a flow restrictor. Then, two pressure-difference-responsive switches are provided, each one sensing a pressure difference at the respective flow restrictor, so as to be responsive to flow rate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
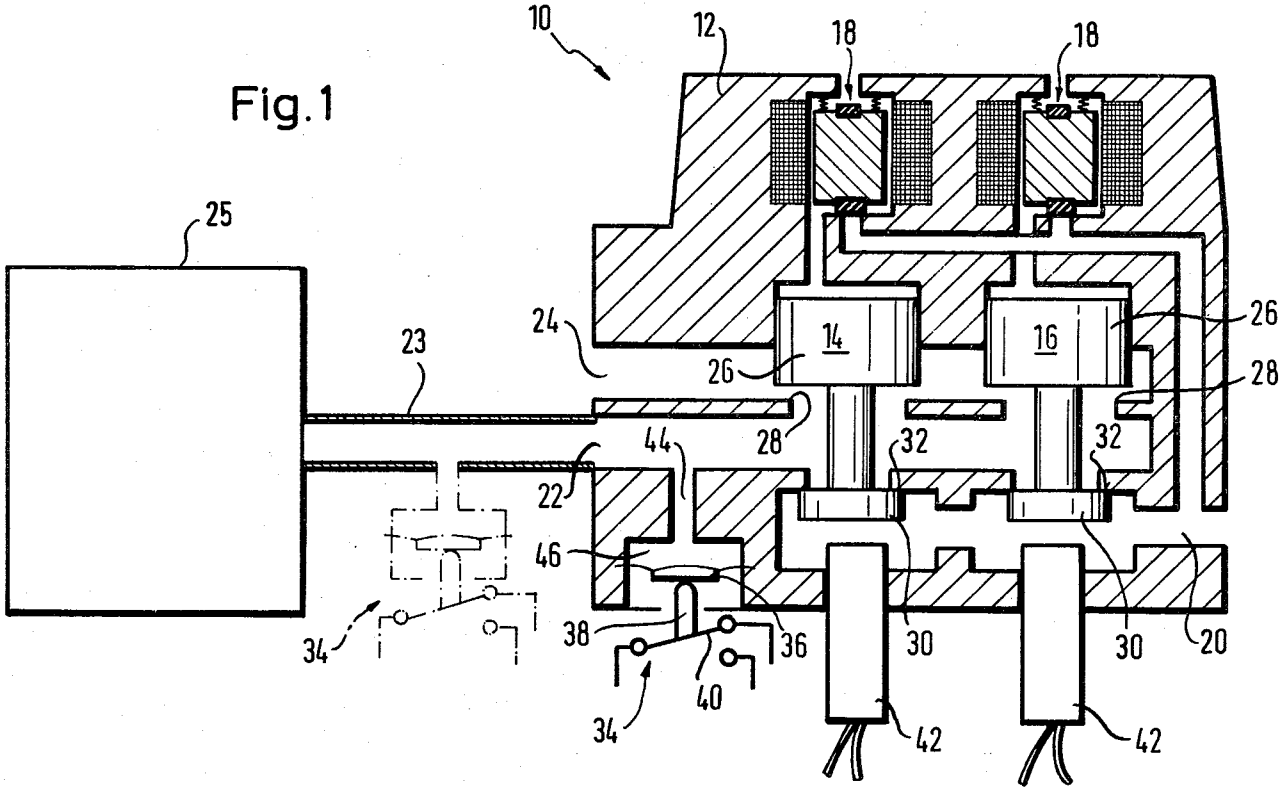
FIG. 1 is a section taken through one exemplary embodiment of an inventive safety valve, here used to control the coupling and brake of a press.

The safety valve 10 depicted in FIG. 1 serves to control the coupling and brake of a press, in this embodiment the coupling and brake being designed as a single consumer 25 receiving pressurized fluid from the safety valve through a single connecting conduit.

The valve 10 comprises a housing 12 in which two switching valves 14, 16 are arranged to act in parallel. Each switching valve 14, 16 is controlled by a respective pilot valve 18. The operation of pilot valves is of course very well known and need not be described in detail here. The housing 12 comprises an inflow port 20 for the supply of pressurized fluid to the switching valves 14, 16, a consumer port 22, and a return-flow port 24. A connecting conduit 23 extends from the consumer port 22 to the consumer 25, here a combined brake and coupling for a press. If the pressurized fluid employed is air, then the return-flow port 24 can discharge to atmosphere.

Each of the two switching valves 14, 16 comprises a work piston 26 which cooperates with a valve plate 30 which in turn cooperates with a valve seat 32. In the situation depicted in FIG. 1, the two switching valves 14, 16 are in the rest or starting setting, i.e., the valve plates 30 are seated on the valve seats 32 and close the latter, whereas the valve seats 28 are open. Accordingly, the feeding of pressurized fluid to the consumer is blocked, whereas the consumer via the conduits 23, 22 and the open valve seats 28 communicates with the return-flow port 24 and thus discharges pressurized fluid. The coupling within consumer 25 is engaged by means of pressurized fluid and disengaged by means of spring force, whereas the brake within consumer 25 is engaged by means of spring force and is disengaged by means of pressurized fluid. In the situation depicted in FIG. 1, therefore, the consumer port 22 is unpressurized, i.e., the coupling is disengaged and the brake is engaged, so that the press is at a standstill.

If now, in conventional manner, the two pilot valves 18 are activated, then the work pistons 26 of the two switching valves 14, 16 are activated by pressure fluid, causing the switching valves to change setting, as a result of which the valve seats 28 close and the valve seats 32 open. The return-flow port 24 is blocked as a result, and the inflow port 22 is opened, so that pressurized fluid can flow from the inflow conduit 20 through the open valve seats 32 to the consumer port 22 and from there through the conduit 23 to the consumer 25. As a result of this, the brake is caused to become released against the action of the spring force trying to engage it, and the coupling is engaged, whereupon the press is activated. The stroke or setting of the two switching valves 14, 16 is now monitored by means of, for example, respective ones of two contactless inductive or capacitive proximity detectors 42. The two monitoring elements 42 activate a (non-illustrated) safety switching device, e.g., an electric switch, when the stroke or settings of the two switching valves 14, 16 do not correspond in time and/or space, i.e., when for example one of the two switching valves does not open or does not close, or becomes jammed during a change of setting, or if one of the two switching valves changes setting with a time delay relative to the other. However, to a limited extent, the changes of setting of the two switching valves 14, 16 need not be exactly identical, e.g., because of the limits implied by dimensional tolerances in manufacturing, and the monitoring devices 42 are preset not to activate such electric shut-off switch if the detected differences are insignificant in this sense.

However, if due to a malfunction the monitoring devices 42 activate the safety switching arrangement, then the latter, which can be mainly comprised of an electric switch, brings the press to a standstill.

If now, by way of example, the seal at the valve seat 32 of one or the other of the two switching valves falls out or loses seal-tightness, or if a break occurs in one of the two valve plates 30, then such a failure is not detected by the two proximity detectors 42. If such a failure occurs with the switching valves in the settings shown in FIG. 1, then pressurized fluid can flow from the inflow conduit 20 through the failure location and accordingly through the affected valve seat 32 and into the conduits 22 and 24. Pressurized fluid which flows into the returnflow conduit 24 is discharged to atmosphere, whereas pressurized fluid which flows into the consumer conduit 22 may cause a more or less small or great pressure build-up.

In order to be able to detect such a malfunction and shut off the press, there is provided in accordance with the present invention a pressure-responsive switch 34. Pressure-responsive switch 34 is located downstream of the switching valves 14, 16 and, as illustrated, can be directly built into the housing 12 of the safety valve or else, as indicated in broken lines, can be located in the connecting conduit 23 connecting the safety valve 10 to the consumer 25; alternatively, the pressure-responsive switch can be located within a pressurized compartment internal to the consumer 25 itself. The pressure-responsive switch 34 communicates via a channel 44 with the consumer port 22. The pressure-responsive switch is provided with a diaphragm 36 coupled to a rod or pusher 38 capable of activating an electric switch 40. The pressurized fluid transmits pressure from the consumer port 22 through the channel 44 into the chamber 46 located in front of diaphragm 36 and presses upon diaphragm 36. If both switching valves 14, 16 and their seals are free of faults, then for the settings shown in FIG. 1 the consumer port 22 communicates with the return-flow port 24 and discharges to atmosphere and pressurized fluid does not displace the diaphragm 36, because the pressures on the two sides of diaphragm 36 are the same. If the switching valves assume their other settings and the consumer receives pressurized fluid, then this pressure displaces diaphragm 36 and activates pressure-responsive switch 34. However, this activation of switch 34 has no particular result at this time, because the pressure-responsive switch 34 is disconnected from the (non-illustrated) safety switch-off device when the switching valves are switched on, i.e., when the return-flow port is blocked and the consumer is receiving pressurized fluid. If now, however, one of the valve plates 30 or one of the seals at the valve seats 32 is faulty then, as already explained, even with the valve setting shown in FIG. 1, pressurized fluid flows from the inflow conduit 20 through the faulty one of the valve seats 32 and into the conduits 22, 24. As a result a so-called residual pressure build-up occurs in conduit 22, and this residual pressure build-up displaces the diaphragm 36 of pressure-responsive switch 34, as a result of which switch 40 changes setting. Whenever the press is at a standstill, i.e., whenever the two switching valves are in the rest or starting settings shown in FIG. 1, the pressure-responsive switch 34 is, i.e., at such times, operatively connected to the (non-illustrated) safety switch-off arrangement of the press; i.e., when diaphragm 36 is displaced by a residual pressure in conduit 22, the signal resulting from activation of switch 40 is then used to completely shut off the press or the control system for the press.

The pressure-responsive switch 34 can also be utilized, with the switching valves switched on, i.e., when the inflow conduit 20 is connected to the consumer conduit 22 and the consumer is being supplied with pressurized fluid, for detecting a pressure drop in the conduits 22, 23 or the absence of a sufficient pressure build-up in these conduits. If this mode of detection is desired, then the pressure-responsive switch 34 must be operatively connected to the safety switch-off arrangement of the press during the times that the switching valves 14, 16 are in their other (non-illustrated) settings in which the return-flow port 24 is blocked, i.e., in the switching-valve settings wherein the valve seats 28 are closed but the valve seats 32 are open to establish communication between conduit 20 and conduit 22. With switching valves 14, 16 in their working settings, if for example sufficient pressure build-up nevertheless fails to occur, e.g., because one of the seals at the valve seats 28 has become loose, or because a break has occurred at one of the work pistons 26 of the switching valves 14, 16, or if the pressure in the conduit 22, 23 drops for example because of a leak in the conduit 23, then this pressure drop or insufficient or non-existent pressure build-up can be utilized to activate the pressure-responsive switch 34, as a result of which a signal is generated completely shutting down the press or shutting off the control system for the press. In this case, the pressure-responsive switch 34 is advantageously so preadjusted that it becomes activated when the pressure in the conduit 23 and the conduit 22 falls below the threshold level to which the consumer 25 can respond or fails to reach this threshold level.

Figure 2:
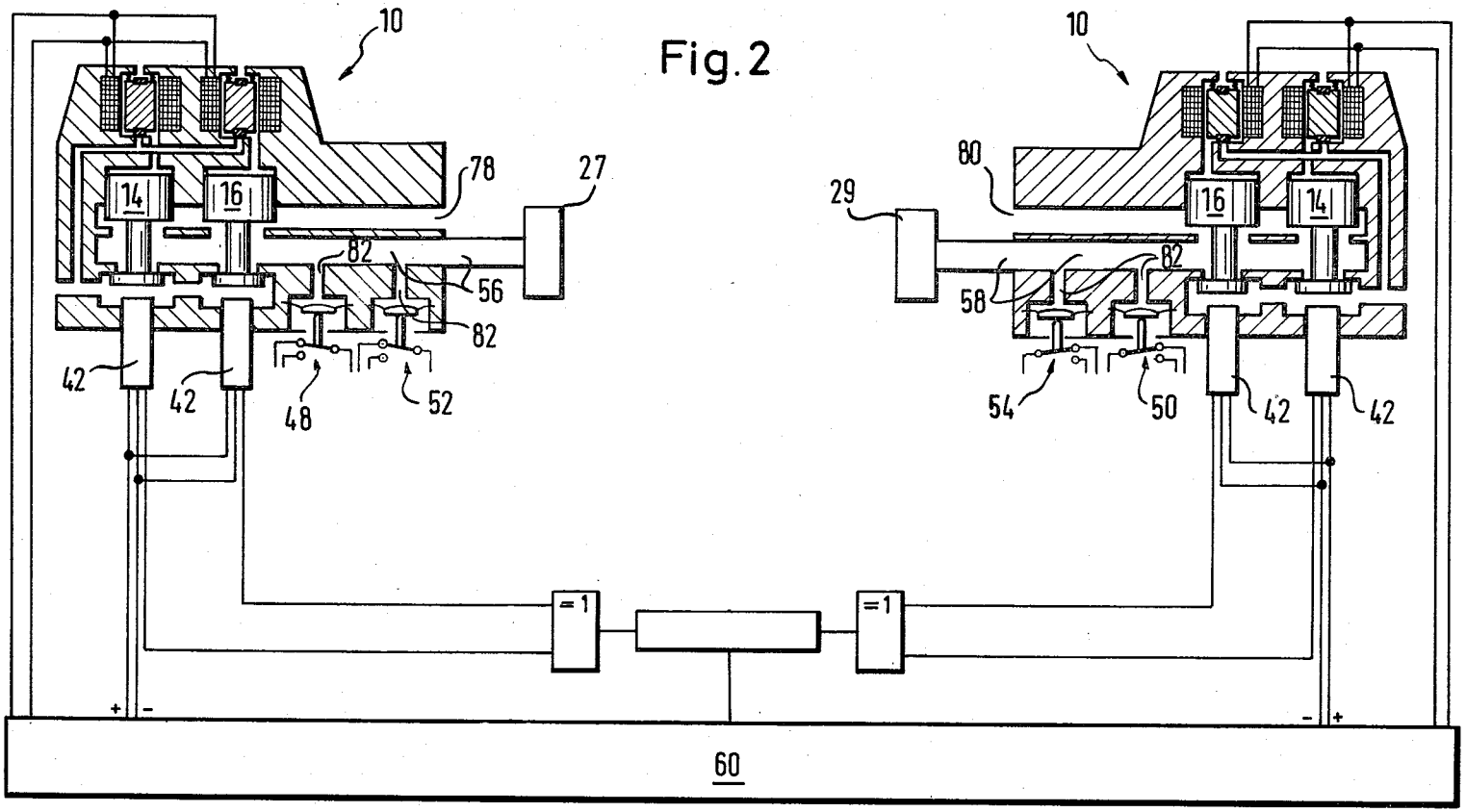
FIG. 2 depicts a tandem arrangement of two inventive safety valves used to control the coupling and brake of a press.

According to a further concept of the invention, the safety valve 10 is provided with two pressure-responsive switches. In the embodiment depicted in FIG. 2, two safety valves 10 are used, and these are each provided with two pressure-responsive switches 48, 52 or 50, 54. FIG. 2 depicts an embodiment in which the coupling and brake of the press are separate, i.e., do not constitute a single consumer. The coupling 27 and the brake 29 each has a respective safety valve 10 of its own. Each of the two safety valves 10 is, as already explained, provided with two pressure-responsive switches. The pressure-responsive switches 48 and 50 respond to the above-defined residual pressure in respective ones of the two consumer conduits 56, 58. The pressure-responsive switches 52 and 54 respond to a pressure drop or to a non-existent or insufficient pressure build-up in respective ones of the consumer conduits 56, 58, i.e., in the sense already explained above with respect to FIG. 1. The use of two pressure-responsive switches per safety valve is advantageous, because then each of the two pressure-responsive switches can be preadjusted to respond to a different respective pressure level. For example, the pressure-responsive switches 48, 50, which are to respond to the above-defined residual pressure, are advantageously set to respond to a lower pressure than the pressure responsive switches 52, 54, which latter are to be responsive to a pressure drop or insufficient pressure build-up in the consumer conduits 56, 58, because switches 52, 54 are to become activated when the pressure in the consumer lines 56, 58 does not reach the threshold level to which the coupling or brake can respond or when the pressure drops below this threshold level.

In FIG. 2, the two safety valves 10 are in the rest or starting setting, i.e., the coupling and the brake discharge to the return-flow ports 78 and 80. The pressure-responsive switches 48, 50 and 52, 54 are all in their starting settings. When this is the situation, both safety valves 10 can be switched on. After this switch-on, pressure is present in the consumer conduits 56 and 58, and this pressure is transmitted via the respective channels 82 to all the pressure-responsive switches 48 to 54, displacing their respective diaphragms and causing their electric switches to change to activated setting. If now during operation of the press one or more of these pressure-responsive switches reverts to its original setting, the resulting electrical signals are then utilized to shut off the control system 60 of the press, so that the press will immediately come to a standstill, with the switching valves then returning to the rest or starting settings depicted in FIG. 2.

As already explained, the pressure-responsive switches 48, 50, which are to respond to a residual pressure in the respective one of conduits 56 and 58, are read out when the press is at a standstill, i.e., when the switching valves are in the settings shown in FIG. 2. The pressure-responsive switches 52, 54, which are to respond to a pressure drop or an insufficient pressure build-up in respective ones of the conduits 56 and 58, are read out during the operation of the press, i.e., when the switching valves are in their working settings.

The following example will make clearer the utility of what has been described above:

The coupling is to be engaged and the brake is to be disengaged. Accordingly the press is to operate and its ram or die perform a complete cycle of movement, i.e., a downwards stroke followed by an upwards stroke. If now, by way of example, the ram or die completes its downward stroke and downwardly passes its lower end position, then it converts to its upwards stroke and moves up towards its upper end position which when reached is to result, in certain circumstances, in shutting off of the press. If now, during the upwards stroke of the ram, the coupling falls, i.e., disengages, e.g., due to a break in conduit 56, then the ram would not be able to complete its upwards stroke and instead would drop down, which of course can lead to serious injury to nearby persons and possibly also damage to equipment. If this is about to happen, the resulting pressure drop is signalled by the pressure-responsive switch 52 and, via the control system 60 for the press, the press is shut off, i.e., the switching valves of the two safety valves 10 return to the starting settings shown in FIG. 2; as a result, the brake is immediately engaged, because the brake requires pressurized fluid for disengagement but is engaged by means of spring force. As shown in FIG. 2, with the switching valves now quickly moved to their starting settings, the consumer conduit 58 discharges to the return-flow port 80, so that the brake 29 can no longer be supplied with pressurized fluid, as a result of which the (non-illustrated) biasing spring of the brake causes the brake to immediately become engaged. The engaging of the brake arrests the ram and prevents it from dropping down.

The safety valves 10 of FIG. 2 can, as illustrated, be additionally provided with contactless proximity detectors 42 operative for indicating the actual settings of the switching values.

Figure 3:
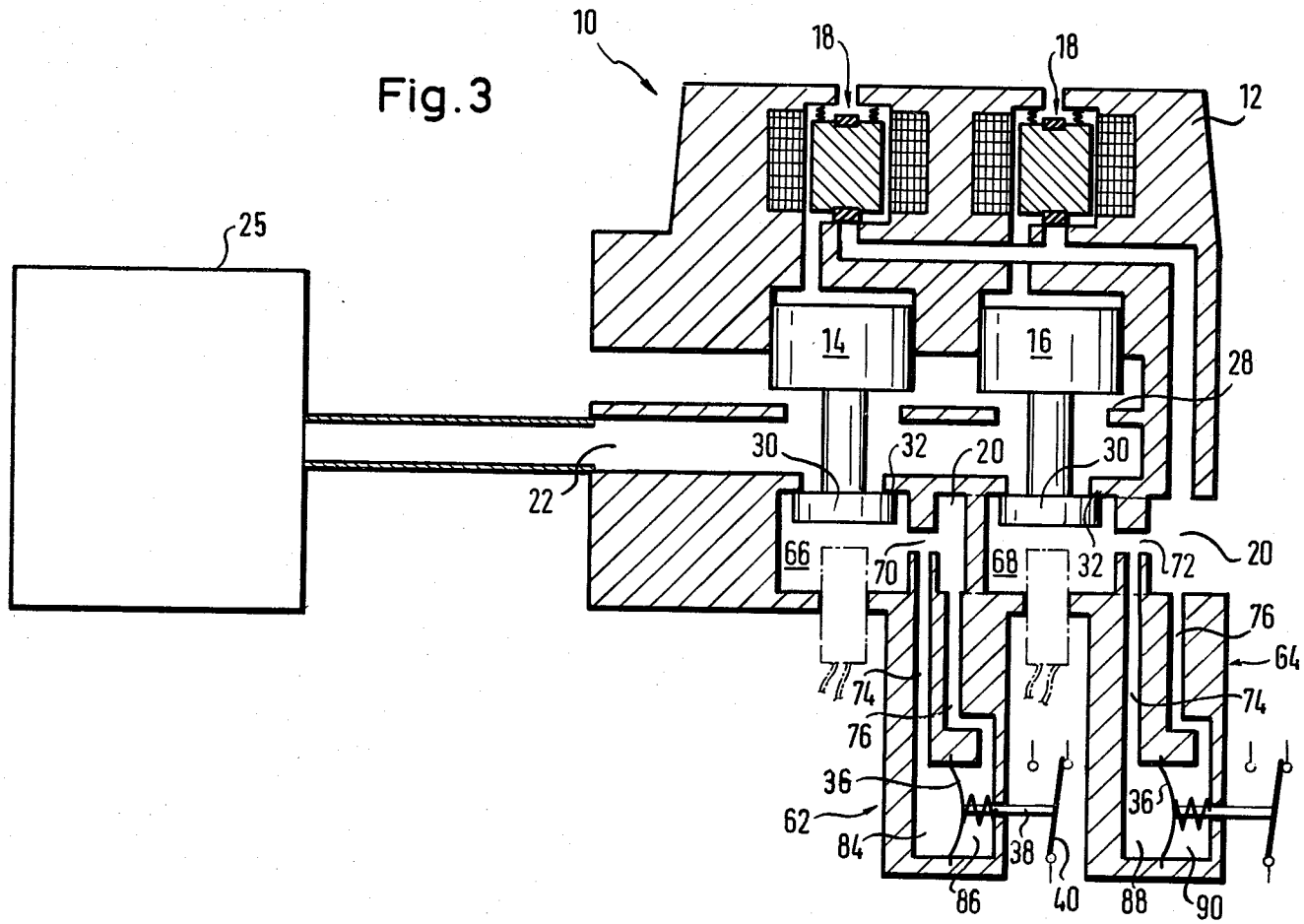
FIG. 3 depicts a modification of the embodiment shown in FIG. 1.

FIG. 3 depicts a further exemplary embodiment of the invention.

Here, it is not the pressure in the consumer conduit 22 which is monitored. Instead, a differential pressure prevailing upstream of the valve plates 30 is monitored, in order to monitor the condition of the switching valves and if necessary trigger the safety switch-off arrangement of the press.

The safety valve 10 in FIG. 3 is provided with two pressure-responsive switches 62, 64 here designed as pressure difference-responsive switches. The two pressure-responsive switches 62, 64 are each located in the path of incoming fluid from the inflow port 20 to the valve plates 30 of the two switching valves. Pressure chambers 66 and 68 are provided upstream of respective ones of the two valve plates 30, and each of the two pressure chambers 66, 68 communicates directly with the inflow port 20. This is clearly shown in FIG. 3 for pressure chamber 68, and it is to be understood that the relationship of pressure chamber 66 relative to inflow port 20 and the valve seat 32 of the respective switching valve 14 is the same as for pressure chamber 68. Each of the two pressure chambers is formed with a respective flow restrictor 70, 72, serving to subdivide the respective pressure chamber into two sections. The diaphragms 36 of the two pressure-responsive switches are exposed to pressurized fluid on both sides, the spaces to both sides of the two diaphragms 36 being indicated by 84 and 86, and by 88 and 90, respectively.

Considering pressure-responsive switch 62, the space 84 in front of diaphragm 36 communicates via a channel 74 with the constricted-flow location of the flow restrictor 70, i.e., the channel 74 opens directly into the flow restrictor 70, whereas the space 86 behind the diaphragm 36 communicates via a channel 76 with the inflow port 20. In the case of pressure-responsive switch 64, the space 88 in front of its diaphragm 66 communicates via a channel 74 with the constricted-flow location of flow restrictor 72, whereas the space 90 behind the diaphragm 36 communicates via a channel 76 with the inflow port 20.

In FIG. 3, the safety valve 10 is depicted in its rest or starting setting. Although there is no flow of pressurized fluid through the safety valve 10, pressure does prevail in the inflow port 20 and, because the chambers 66 and 68 directly communicate with the inflow port 20, substantially identical static pressure prevails in the spaces 84, 86, 88 and 90 of the two pressure-responsive switches, inasmuch as these spaces communicate via the respective channels 74, 76 with the chambers 66, 68 and with the inflow port 20. In the situation depicted in FIG. 3, the diaphragms 36 are displaced as indicated due to the difference in surface area as between the front and back surfaces of these diaphragms, and this is sufficient to keep the associated electric switches 40 in the settings shown.

If now the two switching valves 14, 16 are moved to their working settings, the valve seats 32 open and the valve seats 28 close. As a result, pressurized fluid furnished to inflow port 20 flows at high speed to the switching valves through the flow restrictors 70 and 72. The speed of fluid flow through the flow restrictors 70, 72 per se is higher than that through the inflow port 20 upstream thereof, resulting in a lower pressure at the constricted-flow locations. Accordingly, the pressure prevailing in the spaces 84, 88 in front of the diaphragms 36 is lower than the pressure prevailing in the spaces 86, 90 behind the diaphragms. The two diaphragms 36 displace in the direction towards lower pressure and the electric switches 40 coupled thereto change setting. This pressure difference continues until the consumer 25 and the consumer conduit 22 are filled with pressurized fluid. Thereafter, static conditions once more prevail in the spaces 84 to 90 and the switches 40 revert to the settings shown in FIG. 3.

The foregoing is repeated each time the consumer 25 is again set into operation, so that the safety valve 10 is monitored in a cyclical manner.

If now a failure occurs, e.g., because only one of the two switching valves 14, 16 opens or closes, only the respective one of the two pressure-responsive switches 62, 64 responds. The same occurs if one of the two valve plates 30 is defective, e.g., broken, or if one of the seals on the valve seats 32 is not seal-tight or fails. For any of these instances of malfunction, fluid flows through only one of the two flow restrictors 70, 72, so that a lowered pressure develops in only one of the flow restrictors. As a result, one of the two pressure-responsive switches is activated, namely the one at whose flow restrictor the lowered pressure develops, the other pressure-responsive switch not changing setting. The fact that the settings of the two pressure-responsive switches are now not identical indicates a malfunction of the safety valve, and the non-identical settings of the two electric switches 40 causes the press to come to a standstill.

By way of example, consider the following situation. The left switching valve 14 opens properly, whereas the right switching valve 16 jams in the illustrated rest setting. In that case, pressurized fluid flows only through the flow restrictor 70, but not through the flow restrictor 72 because the valve seat 32 associated with jammed switching valve 16 is still closed. Due to the lowered pressure in the constricted-flow area at 70 and the resulting pressure difference as between the spaces 84, 86 of the left pressure-responsive switch 62, the latter changes setting; in contrast, the right pressure-responsive switch 64 does not change setting because the pressures prevailing in the spaces 88, 90 are substantially equal.

In addition to the foregoing, the settings of the two switching valves 14, 16 can furthermore be monitored by means of contactless proximity detectors such as 42 in FIGS. 1 and 2.

In the embodiment of FIG. 3, the coupling and brake are combined into a single unit as in FIG. 1 and supplied with pressurized fluid via one consumer conduit 22. Alternatively, however, the coupling and brake could be separate consumers, each provided with a respective safety valve 10 such as shown in FIG. 3, i.e., in the manner of FIG. 2.

Typically, when the coupling and brake are to be activated, the safety valve for the brake and the safety valve for the coupling are electrically activated simultaneously. Alternatively, however, the safety valve for the coupling can be activated after a time delay subsequent to activation of the safety valve for the brake, i.e., only after a signal has been generated indicating that the safety valve for the brake is not malfunctioning.

For example, the safety valve for the brake receives an electrical control signal. If both pressure-responsive switches of the brake safety valve respond, then this means that the brake safety valve is in order, whereupon the start signal for the coupling safety valve can be generated. In contrast, if only one of the two pressure-responsive switches of the brake safety valve responds, then this indicates that the brake safety valve is not in order, and in this situation no start signal for the coupling safety valve is generated.

It can also happen that the two pressure-responsive switches (pressure difference-responsive switches) of the brake safety valve change setting, but thereafter fail to revert to their previous setting, because for example a break in a conduit has prevented the build-up of pressure; in that case, likewise, no start signal is generated for the coupling safety valve.

Finally, it can happen that, after switching on the coupling safety valve, only one of the pressure-responsive switches of the coupling safety valve responds, this indicating a malfunction which triggers shut-off of the press. If both pressure-responsive switches of the coupling safety valve change setting when the safety valve is switched on, but then, after elapse of a time delay corresponding to the time required for the coupling to become activated, they fail to revert to their previous settings, this indicates that no pressure build-up in the coupling has occurred, e.g., due to a break in a conduit, whereupon via the control system for the press the press is shut off.

The advantage of these latter expedients is that malfunction-free performance of one operating step is a prerequisite for initiation of the performance of the next operating step.

It will be understood that each of the elements described above, or two or more together, may also find a useful application in other types of constructions and switch-off techniques differing from the types described above.

While the invention has been illustrated and described as embodied in the context of a safety valve used to control a press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A safety valve arrangement for controlling a consumer driven by pressurized fluid, in particular a control device of a press, the safety valve arrangement including a safety valve comprising a valve housing; two switching valves in the valve housing connected to act in parallel; a connecting conduit provided between the safety valve and the consumer for permitting pressurized fluid to be transmitted to the consumer and for permitting pressurized fluid to discharge from the consumer; means controlling the settings of the two switching valves; and shut-off means operative for generating in response to malfunction a shut-off signal commanding that the consumer by shut-off, the shut-off means comprising pressure-responsive switch means coupled to said connecting conduit for sensing at least one predetermined pressure value in the fluid transmitted through said connecting conduit, said pressure-responsive switch means comprising a first pressure-responsive switch operative for generating a signal when despite the fact that the switching valves are in the closed setting pressure is building up intermediate the safety valve and the consumer, and a second pressure-responsive switch operative for generating a signal when despite the fact that the switching valves are in the open setting the pressure intermediate the safety valve and the consumer is lower than a predetermined value.

2. The safety valve arrangement defined in claim 1, the pressure-responsive switch means being located in the housing of the safety valve.

3. The safety valve arrangement defined in claim 1, the pressure-responsive switch means being located to sense the pressure of pressurized fluid within the consumer.

4. The safety valve arrangement defined in claim 1, the safety valve arrangement controlling the supply of fluid to two consumers, the two consumers being control device of a press, the safety valve arrangement comprising two safety valves each one being as defined above and each one comprising a respective first pressure-responsive switch as defined above and a respective second pressure-responsive switch as defined above.

* * * * *